US010634432B2

(12) United States Patent
Devedeux et al.

(10) Patent No.: US 10,634,432 B2
(45) Date of Patent: Apr. 28, 2020

(54) HEAT EXCHANGER

(71) Applicant: Valeo Systemes Thermiques, Le Mesnil Saint Denis (FR)

(72) Inventors: Sébastien Devedeux, Versailles (FR); Laurent Odillard, Le Luart (FR); Benjamin Ferlay, Cernay la Ville (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 13 days.

(21) Appl. No.: 15/513,047

(22) PCT Filed: Sep. 23, 2015

(86) PCT No.: PCT/EP2015/071888
§ 371 (c)(1),
(2) Date: Mar. 21, 2017

(87) PCT Pub. No.: WO2016/046270
PCT Pub. Date: Mar. 31, 2016

(65) Prior Publication Data

US 2017/0284743 A1 Oct. 5, 2017

(30) Foreign Application Priority Data

Sep. 23, 2014 (FR) ..... 14 58942

(51) Int. Cl.
*F28D 1/053* (2006.01)
*F28F 9/02* (2006.01)
(Continued)

(52) U.S. Cl.
CPC ..... *F28D 1/05375* (2013.01); *F28D 15/00* (2013.01); *F28F 1/00* (2013.01);
(Continued)

(58) Field of Classification Search
CPC .... F28F 9/04; F28F 9/0251; F28F 1/00; F28F 9/0226; F28F 2275/122; F28D 1/05375; F28D 15/00; F28D 2021/0082
See application file for complete search history.

(56) References Cited

U.S. PATENT DOCUMENTS 4,331,201 A * 5/1982 Hesse ..... B23P 11/00 165/149
5,899,267 A 5/1999 Kroetsch et al.
(Continued)

FOREIGN PATENT DOCUMENTS

FR 2 422 921 A1 11/1979

OTHER PUBLICATIONS

International Search Report issued in PCT/EP2015/071888 dated Jan. 25, 2016 (2 pages).
(Continued)

*Primary Examiner* — Gordon A Jones
(74) *Attorney, Agent, or Firm* — Osha Liang LLP

(57) ABSTRACT

The present invention relates to a heat exchanger (1) comprising:
- a heat exchange core bundle (3) in which a first heat-transfer fluid circulates,
- at least one inlet tank (5*a*) or outlet tank (5*b*) for a second heat-transfer fluid,
- at least one collector (7) arranged on the periphery of the heat exchange core bundle (3) and comprising a lateral wall (75) of which at least two portions (77) are folded over so as to fix the tank (5*a*, 5*b*) by crimping against the heat exchange core bundle (3), the lateral wall (75) following the contour of at least one corner of the heat exchange core bundle (7), said lateral wall (75) comprising, on each side of the corner, a folded-over portion (77) and comprising in the region of said corner a
(Continued)

Figure 1:
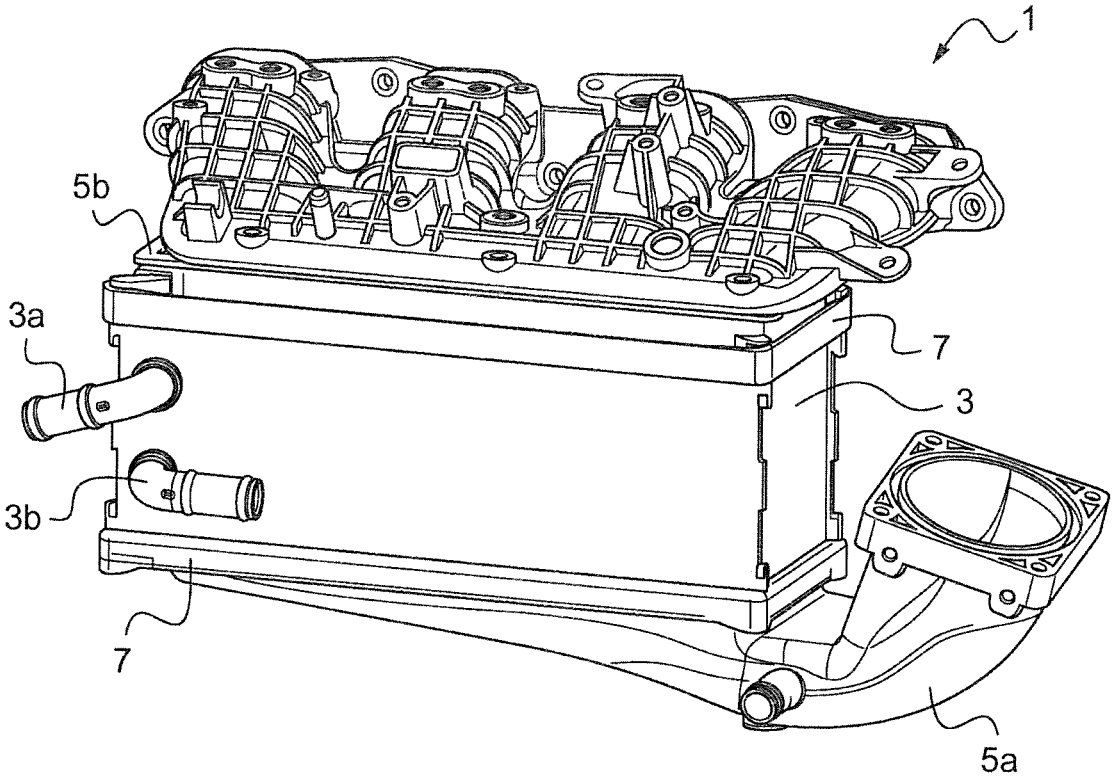

non-folded-over portion (79), the folded-over portions (77) being connected continuously to the non-folded over portion (79).

9 Claims, 2 Drawing Sheets

(51) Int. Cl.
*F28D 15/00* (2006.01)
*F28F 1/00* (2006.01)
*F28D 21/00* (2006.01)

(52) U.S. Cl.
CPC ..... *F28F 9/0226* (2013.01); *F28F 9/0251* (2013.01); *F28D 2021/0082* (2013.01); *F28F 2275/122* (2013.01)

(56) References Cited

U.S. PATENT DOCUMENTS

| | | | | |
|---|---|---|---|---|
| 6,082,446 | A * | 7/2000 | Ahaus | F28F 9/0226 165/149 |
| 7,156,401 | B2 * | 1/2007 | Merklein | F28F 9/0226 165/149 |
| 2011/0168364 | A1 * | 7/2011 | Okuyama | F28F 9/0226 165/148 |
| 2013/0192803 | A1 * | 8/2013 | Garret | F28D 7/1684 165/151 |
| 2017/0131043 | A1 * | 5/2017 | Contet | F28F 9/0224 |

OTHER PUBLICATIONS

Written Opinion of the International Searching Authority issued in PCT/EP2015/071888 dated Jan. 25, 2016 (4 pages).

* cited by examiner

HEAT EXCHANGER

The invention relates to the field of heat exchangers and more particularly to the fixing between a heat exchange core bundle and a heat-transfer fluid inlet or outlet tank.

A heat exchanger, such as, for example, a charge air cooler, generally comprises a heat exchange core bundle comprising tubes inside which a first heat-transfer fluid circulates. The heat exchanger also comprises inlet and outlet tanks for a second heat-transfer fluid, in this instance the charge air coming from a turbocharger. The inlet and outlet tanks are fixed to the heat exchange core bundle in such a way that the second heat-transfer fluid circulates between the tubes and can exchange heat energy with the first heat-transfer fluid.

During the process of manufacturing the heat exchanger, the tanks are generally fixed to the heat exchange core bundle by means of a collector. This collector may for example be a metal sheet on the periphery of the heat exchange core bundle comprising crimping tabs which are folded over onto the tank using crimping tools in order to crimp said tank.

Nevertheless, with time and because of vibrations, these crimping tabs may experience stresses that cause cracks to form at their base. These cracks may ultimately cause the crimping tab to break and therefore weaken the fixing of the tank to the heat exchange core bundle.

It is therefore one of the objects of the present invention to at least partially overcome the disadvantages of the prior art and to provide a heat exchanger with improved fixing between a second fluid inlet or outlet tank and a heat exchange core bundle.

The present invention therefore relates to a heat exchanger comprising:

- a heat exchange core bundle in which a first heat-transfer fluid circulates,
- at least one inlet tank or outlet tank for a second heat-transfer fluid, said tank comprising a bearing zone and at least one shoulder oriented toward the outside of said tank in the region of the bearing zone,
- at least one collector arranged on the periphery of the heat exchange core bundle and comprising:
  - a base on which the bearing zone of the tank is intended to rest,
  - a lateral wall of which at least two portions are folded over onto the shoulder so as to fix the tank by crimping against the heat exchange core bundle, the lateral wall following the contour of at least one corner of the heat exchange core bundle, said lateral wall comprising, on each side of the corner, a folded-over portion and comprising in the region of said corner a non-folded-over portion, the folded-over portions being connected continuously to the non-folded-over portion.

The fact that the lateral wall follows the contour of the corners makes it possible to limit the risks of breakage at the folded-over portion. Specifically, this configuration prevents the concentration of stresses, for example caused by vibrations, and distributes them over the entire length of the lateral wall.

According to one aspect of the invention, the folded-over portions are connected continuously to the non-folded-over portion by a portion under torsion According to another aspect of the invention, the thinning of the thickness of the lateral wall in the region of the portions under torsion is less than or equal to 20%.

According to another aspect of the invention, the tank is crimped by the collector over at least one quarter of its length between two corners of the heat exchange core bundle.

According to another aspect of the invention, the lateral wall is continuous over the entire periphery of the heat exchanger.

According to another aspect of the invention, a seal is arranged between the bearing zone of the tank and the base of the fixing device.

According to another aspect of the invention, the seal is placed in a groove within the base of the fixing device.

According to another aspect of the invention, the tank comprises, in the region of at least one corner of the heat exchange core bundle, a buffer that presses against the edge face of the non-folded-over portion and a leg perpendicular to said buffer, said leg compressing the seal.

According to another aspect of the invention, the collector is formed as one with the heat exchange core bundle.

According to another aspect of the invention, the collector is an element fixed on the periphery of the heat exchange core bundle.

Figure 2:
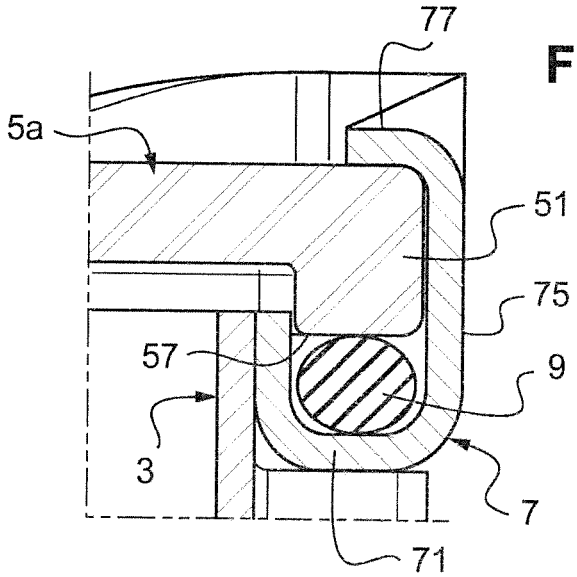
Figure 3:
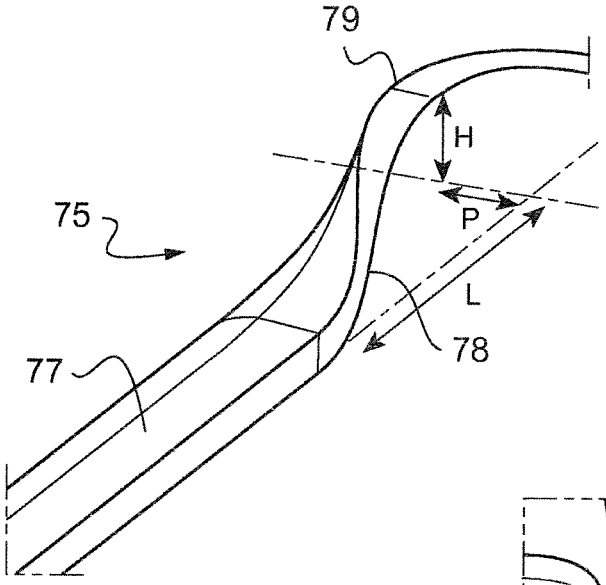
Figure 4:
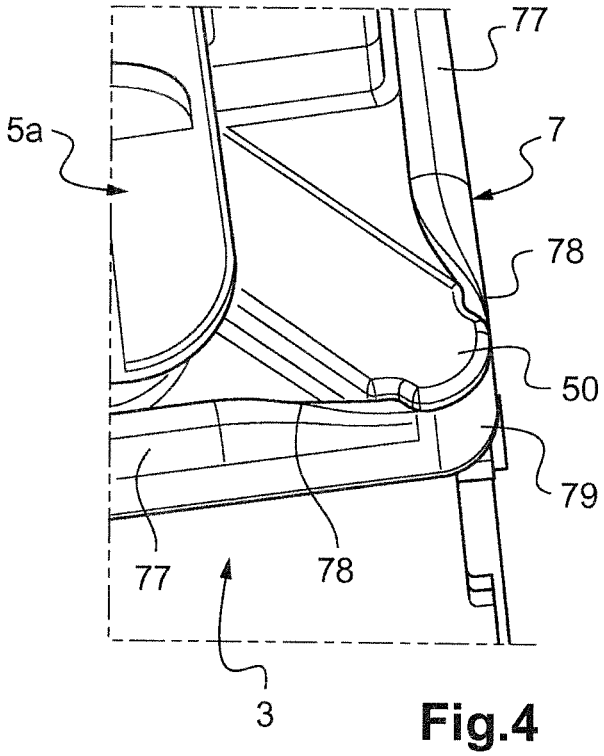
Figure 5:
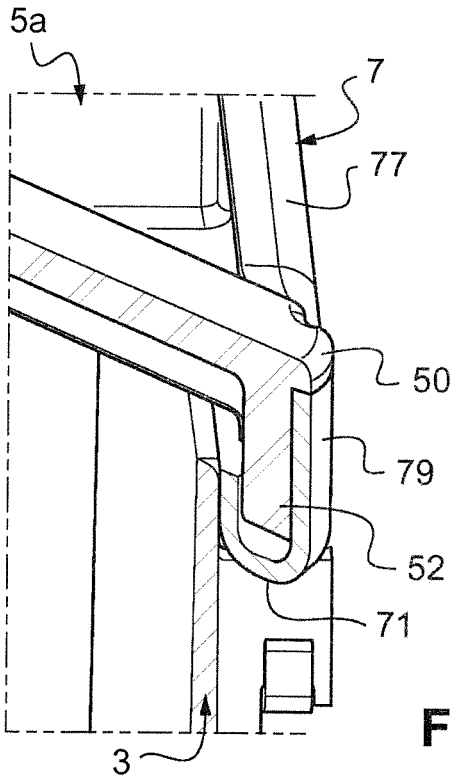

Other features and advantages of the invention will become more clearly apparent from reading the following description, given by way of nonlimiting illustrative example, and from studying the attached drawings among which:

FIG. 1 is a schematic perspective depiction of a heat exchanger,

FIG. 2 is a schematic depiction in cross section of a fixing zone for the fixing of a tank to a heat exchange core bundle, after fixing, FIG. 3 is a schematic perspective depiction of a collector in the region of a corner of the heat exchanger, FIG. 4 is a schematic perspective depiction of a corner of the heat exchanger according to one particular embodiment, FIG. 5 is a schematic depiction in part-section of a corner of the heat exchanger according to the particular embodiment of FIG. 4.

In the various figures, the elements that are identical bear the same reference numerals.

As illustrated by FIG. 1 which is a schematic perspective depiction of a heat exchanger 1, in this instance a charge air cooler, the latter comprises:

- a heat exchange core bundle 3 comprising tubes or a collection of plates (not visible) in which a first heat-transfer fluid circulates between an inlet pipe 3*a* and an outlet pipe 3*b* for said first heat-transfer fluid,
- at least one inlet tank 5*a* or outlet tank 5*b* of a second heat-transfer fluid, and
- at least one collector 7 of the tank 5*a*, 5*b* on the heat exchange core bundle 3.

The heat exchange core bundle 3 generally adopts a parallelepipedal shape, a first collector 7 following the periphery of one face of said heat exchange core bundle 3 and a second collector 7 following the periphery of the opposite face.

The collector 7 may be formed as one with the heat exchange core bundle 3 or alternatively may be an element fixed to the periphery of the heat exchange core bundle 3, for example by brazing.

As shown in greater detail in FIG. 2, the collector 7 comprises a base 71 on which a bearing zone 57 of the tank 5*a*, 5*b* is intended to rest. The tank 5*a*, 5*b* itself comprises at least one shoulder 51 oriented toward the outside of said tank 5*a*, 5*b*. This shoulder 51 is arranged in the region of its bearing zone 57.

The collector 7 also comprises a lateral wall 75 which is folded over onto the shoulder 51 in order to fix the tank 5*a*, 5*b* by crimping. In order for the fixing to be effective, the heat exchanger 1 comprises at least two portions 77 that are folded over onto the shoulder 51, preferably on opposite sides of one and the same face.

In the example shown in FIG. 1, there is a continuous folded-over portion 77 on each side of the heat exchanger 1.

In order to seal the fixing of the tanks 5*a*, 5*b* against the heat exchange core bundle 3, a seal 9 may be placed between the bearing zone 57 of the tank 5*a*, 5*b* and the base 71 of the collector 7. When the tank 5*a*, 5*b* is fixed, the seal 9 is compressed between the bearing zone 57 and the base 71, as is illustrated in FIG. 2. The seal 9 may notably be placed in a groove within the base 71 of the collector 7. It is nevertheless entirely possible to conceive of the seal 9 being incorporated directly into the bearing zone 57.

The lateral wall 75 of the collector 7 continuously follows the contour of a corner of the heat exchange core bundle 7. This following of a corner by the lateral wall 75 is illustrated in greater detail in FIG. 3. In the region of a corner, the lateral wall 75 comprises, on either side of the corner of the heat exchange core bundle 3, a folded-over portion 77 and, at the corner of the heat exchange core bundle 3, a non-folded-over portion 79. The folded-over portions 77 are connected continuously to the non-folded-over portion 79 by a portion 78 of the lateral wall 75 that is under torsion.

The fact that the lateral wall follows the contour of the corners makes it possible to limit the risks of breakage in the region of the folded-over portion 77. Specifically, this configuration prevents a concentration of stresses, for example caused by vibrations, and distributes the stresses over the entire length of the lateral wall 75.

As FIG. 1 shows, it is advantageous for the lateral wall 75 of the collector 7 to follow the contour of all the corners of one and the same face of the heat exchange core bundle 3.

In order to maintain sufficient ability to withstand stress, the thinning of the thickness of the lateral wall 75 of the collector 7 in the region of the portions 78 under torsion is preferably less than or equal to 20%.

In order to control this thinning, the configuration and geometry of the lateral wall 75 in the region of the corners of the heat exchange core bundle 3 may be defined according to various parameters and using the following formula:

$$L=P\times(a1\times H=b1)(a2\times H+b2)$$

L corresponds to the length between the non-folded-over wall 79 and the folded-over portion 77 along the axis of folding of the portion 77.

P corresponds to the depth of crimping, namely to the distance between the inside of the wall 79 and the end of the folded-over portion 77, in the direction of crimping of the folded-over portion 77.

H corresponds to the height of the non-folded over portion 79, namely to the distance between the plane formed by the shoulder 51 and the top of the non-folded-over portion 79.

The values a1, a2, b1 and b2 are constants obtained by trial and error as a function of various thinnings of the thickness of the collector 7. These constants are given in the table below:

| Thinning % | a1 | b1 | a2 | b2 |
|---|---|---|---|---|
| 3.3 | −0.36 | 3.89 | 4.02 | −4.40 |
| 6.7 | −0.25 | 2.68 | 2.77 | −3.03 |
| 10.0 | −0.20 | 2.13 | 2.20 | −2.41 |

-continued

| Thinning % | a1 | b1 | a2 | b2 |
|---|---|---|---|---|
| 13.3 | −0.17 | 1.79 | 1.85 | −2.03 |
| 16.7 | −0.14 | 1.55 | 1.61 | −1.76 |
| 20.0 | −0.13 | 1.37 | 1.42 | −1.56 |
| 23.3 | −0.11 | 1.23 | 1.27 | −1.39 |
| 26.7 | −0.10 | 1.11 | 1.15 | −1.26 |
| 30.0 | −0.09 | 1.01 | 1.04 | −1.14 |
| 33.3 | −0.08 | 0.92 | 0.95 | −1.04 |

In order for the fixing of the tank 5*a*, 5*b* to be as effective and robust as possible, this tank is crimped by the collector 7 over at least one quarter of its length between two corners of the heat exchange core bundle 3.

In the embodiment shown in FIG. 1, the collector 7 comprises a lateral wall 75 that is continuous around the entire periphery of the heat exchanger 1. Thus, the collector 7 does not have crimping tabs but instead has folded-over portions 79 along each side of the heat exchanger 1, the folded-over portions 79 connecting the portions 79 under torsion at the corners. As a result, the collector 7 is better able to withstand stress, for example stress associated with vibrations, because the stresses are distributed over the entire length of the sides of the heat exchanger 1 and over the entire length of the lateral wall 75.

As illustrated in FIGS. 4 and 5, the tank 5*a*, 5*b* may, at least at one corner of the heat exchange core bundle 3, comprise a buffer 50 that comes to bear against the edge face of the non-folded-over portion 79 at a corner of the heat exchanger 1. The tank 5*a*, 5*b* may also comprise a leg 52 perpendicular to said buffer 50. As the tank 5*a*, 5*b* is placed on the heat exchange core bundle 3, the buffer 20 comes into contact with the edge face of the non-folded-over portion 79 and the leg 52 compresses the seal 9. The length of the leg 52 determines the compression of the seal 9 on the periphery of said heat exchanger 1.

Thus it may be clearly seen that the heat exchanger 1 according to the present invention, on account of the specific configuration of the collector 7, notably at the corners, allows better resistance to stress and therefore better durability of the fixing between the heat exchange core bundle 3 and the tank 5*a*, 5*b*.

The invention claimed is:

1. A heat exchanger comprising:

a heat exchange core bundle in which a first heat-transfer fluid circulates, the heat exchange core bundle comprising a plurality of tubes or plates;

at least one inlet tank or outlet tank for a second heat-transfer fluid, said at least one inlet tank or outlet tank comprising a bearing zone and at least one shoulder oriented toward the outside of said at least one inlet tank or outlet tank in a region of the bearing zone; and at least one collector extending around the plurality of tubes or plates of the heat exchange core bundle and comprising:

a base on which the bearing zone of the at least one inlet tank or outlet tank is intended to rest, a lateral wall of which at least two folded-over portions are folded over to contact a planar surface of the at least one shoulder along a continuous edge of the lateral wall so as to fix the at least one inlet tank or outlet tank by crimping against the heat exchange core bundle, wherein the continuous edge follows a contour of at least one corner of the heat exchange core bundle, said lateral wall comprising, on each side of the at least one corner, one of the at least two folded-over portions and comprising in a region of said at least one corner a non-folded-over portion, a portion of the continuous edge disposed in the non-folded-over portion is separated from the planar surface of the at least one shoulder, in a direction perpendicular from the planar surface, by a height of the non-folded-over portion, and wherein the at least two folded-over portions are connected continuously to the non-folded-over portion by a portion under torsion within which the continuous edge is separated from the planar surface of the at least one shoulder by a variable height decreasing, in a direction from the non-folded-over portion to each of the at least two folded-over portions, from the height of the non-folded-over portion.

2. The heat exchanger as claimed in the preceding claim 1, wherein a thinning of the thickness of the lateral wall in a region of the portion under torsion is less than or equal to 20%.

3. The heat exchanger as claimed in claim 1, wherein the at least one inlet tank or outlet tank is crimped by the at least one collector over at least one quarter of a length of the at least one inlet tank or outlet tank between two corners of the heat exchange core bundle.

4. The heat exchanger as claimed in claim 1, wherein the lateral wall is continuous over an entire periphery of the heat exchanger.

5. The heat exchanger as claimed in claim 1, wherein a seal is arranged between the bearing zone and the base of the at least one collector.

6. The heat exchanger as claimed in claim 5, wherein the seal is placed in a groove within the base of the at least one collector.

7. The heat exchanger as claimed in claim 4, wherein the at least one inlet tank or outlet tank comprises, in the region of the at least one corner, a buffer that presses against an edge face of the non-folded-over portion and a leg perpendicular to said buffer, said leg compressing a seal.

8. The heat exchanger as claimed in claim 1, wherein the at least one collector is formed as one with the heat exchange core bundle.

9. The heat exchanger as claimed in claim 1, wherein the at least one collector is an element fixed on a periphery of the heat exchange core bundle.

* * * * *